US006227319B1

(12) United States Patent
Radford

(10) Patent No.: US 6,227,319 B1
(45) Date of Patent: May 8, 2001

(54) SUPERABRASIVE CUTTING ELEMENTS AND DRILL BIT SO EQUIPPED

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/346,359

(22) Filed: Jul. 1, 1999

(51) Int. Cl.[7] ..... E21B 10/46
(52) U.S. Cl. ..... 175/432; 175/431
(58) Field of Search ..... 175/431, 432, 175/428, 434, 430

(56) References Cited

U.S. PATENT DOCUMENTS

| | | | | |
|---|---|---|---|---|
| 4,629,373 | | 12/1986 | Hall . | |
| 5,007,207 | | 4/1991 | Phaal . | |
| 5,011,515 | | 4/1991 | Frushour . | |
| 5,351,772 | | 10/1994 | Smith . | |
| 5,355,969 | | 10/1994 | Hardy et al. . | |
| 5,469,927 | | 11/1995 | Griffin . | |
| 5,472,376 | * | 12/1995 | Olmstead et al. | 175/432 X |
| 5,484,330 | | 1/1996 | Flood et al. . | |
| 5,486,137 | | 1/1996 | Flood et al. . | |
| 5,564,511 | | 10/1996 | Frushour . | |
| 5,590,728 | | 1/1997 | Matthias et al. . | |
| 5,598,750 | | 2/1997 | Griffin et al. . | |
| 5,605,199 | | 2/1997 | Newton . | |
| 5,611,649 | | 3/1997 | Matthias . | |
| 5,617,928 | | 4/1997 | Matthias et al. . | |
| 5,622,233 | | 4/1997 | Griffin . | |
| 5,709,279 | | 1/1998 | Dennis . | |
| 5,816,347 | * | 10/1998 | Dennis et al. | 175/432 |
| 5,862,873 | | 1/1999 | Matthias et al. . | |
| 5,957,228 | | 9/1999 | Yorston et al. . | |
| 6,026,919 | | 2/2000 | Thigpen et al. . | |
| 6,029,760 | * | 2/2000 | Hall | 175/432 |
| 6,041,875 | * | 3/2000 | Rai et al. | 175/432 |
| 6,082,474 | | 7/2000 | Matthias . | |

* cited by examiner

*Primary Examiner*—Frank Tsay
(74) *Attorney, Agent, or Firm*—Trask Britt

(57) ABSTRACT

A superabrasive cutting element attachable to a drill bit for drilling subterranean formations is formed of a substrate and a superabrasive table with a three-dimensional interface comprising a continuous wave pattern extending about a central axis. Multiple outwardly directed arches of the wave pattern are oriented and configured to preferentially accommodate loading experienced by the cutting element during drilling to absorb and distribute stresses resulting therefrom. Thus, any tendency toward fracture and spalling of the superabrasive table and delamination thereof from the substrate, any of which may induce catastrophic failure of the cutting element, are substantially reduced. A rotary drill bit including such cutting elements is also disclosed.

36 Claims, 9 Drawing Sheets

SUPERABRASIVE CUTTING ELEMENTS AND DRILL BIT SO EQUIPPED

BACKGROUND OF THE INVENTION

1. Field of the Invention

This invention relates generally to superabrasive cutting elements and, more specifically, to polycrystalline diamond compact cutting elements comprising a polycrystalline diamond table formed and bonded to a supporting substrate or backing during formation of the cutting element and drill bits for subterranean drilling equipped with such cutting elements.

2. State of the Art

Superabrasive elements are used extensively in drilling, cutting, milling, and other operations relating to the removal of portions of hard materials. A superabrasive element useful in subterranean, drilling may conventionally include a table formed of polycrystalline diamond particles or, less typically, cubic boron nitride particles sintered under high pressure, high temperature conditions into a coherent conglomerate mass termed a "compact." In order to support the hard but relatively brittle table, it is typically bonded during sintering to a substrate of, e.g., cemented carbide. A plurality of such cutting elements is typically mounted to a rotary drill bit for drilling subterranean formations.

Typically, such cutting elements are formed by placing a cemented tungsten carbide substrate preform into a press, and placing, for example, diamond grains, optionally with a catalyst binder, atop the substrate preform. Under the aforementioned high pressure and temperature, the diamond grains are bonded to each other and to the substrate in the sintering process, forming a diamond table.

Polycrystalline diamond compact cutting elements, commonly known as PDCs, have been commercially available for more than 20 years and have been widely used, particularly on bits for subterranean drilling. In a variation of the PDC, residual metal and catalyst is leached from the diamond table to form a thermally stable product (TSP), or a silicon-bonded TSP may be formed, silicon having a coefficient of thermal expansion (CTE) similar to that of diamond.

The use of PDC and TSP cutting elements in rotary drag bits for earth boring has resulted in major increases in penetration rates and overall reductions in drilling costs for a broadened range of rock formation types.

Nevertheless, several problems have become evident in using PDC and TSP cutting elements. High residual stresses attributable to the aforementioned high pressure, high temperature fabrication conditions may be present in such cutting elements, particularly adjacent the table-substrate interface, and may lead to fracturing of the superabrasive table, separation from the substrate and failure of the element. Such stresses are largely attributable to the differences in CTE between the diamond and the carbide; cooling of the cutting element after fabrication results in greater shrinkage of the substrate than of the polycrystalline diamond material.

Furthermore, spalling, fracture and delamination of the table material from the substrate may occur during attachment of the cutting element to a tool, or during normal drilling operations, because of high bending forces applied during attachment, or by contact with the subterranean formation itself as weight on bit (WOB) is applied and torque is applied to rotate the bit to engage the formation. Diamond has an extremely low strain rate to failure and cannot tolerate flexing resulting from high applied forces.

Fracture or delamination, once initiated, ultimately leads to failure of the cutting element. Any means to reduce the frequency of bit failure will have a significant beneficial economic effect in drilling operations.

Various attempts have been made to reduce the incidence of cutting element failures adjacent the table/substrate interface.

In U.S. Pat. No. 4,629,373 of Hall, the substrate is eliminated, and the cutting table is directly attached to, e.g., a metal drill bit. The attachment surface is formed with surface irregularities including parallel grooves, crosshatch grooves, wire-mesh grooves, and the like.

The disclosure of Griffin in U.S. Pat. No. 5,469,927 teaches the addition of a transition layer between the cutting table and the substrate, in which the transition layer has at least one property intermediate the properties of the cutting table and the substrate. In U.S. Pat. No. 5,011,515 of Frushour, a transition layer has properties which gradually vary from the cutting table to the substrate.

The substrate-table interface may be formed with a series of sloping surfaces about a central axis, as depicted in U.S. Pat. Nos. 5,484,330 and 5,486,137 of Flood et al.

In U.S. Pat. No. 5,709,279 of Dennis, the table-substrate interface is formed in an undulating sinusoidal wave fonn, the sine wave amplitude varying in a direction parallel to the central axis.

As taught in U.S. Pat. No. 5,605,199 of Newton, the cutting table may be formed with increased thickness about its periphery. In addition, a series of adjacent, parallel, straight grooves and ridges in the interface is shown.

In U.S. Pat. No. 5,564,511 of Frushour and U.S. Pat. No. 5,622,233 of Griffin, the table/substrate interface is proposed to be formed with a plurality of-discrete protuberances projecting perpendicularly to the general interfacial plane. The protuberances may be bulbous or conical, the interface resembling an egg carton or acoustical foam.

In U.S. Pat. No. 5,007,207 of Phaal and U.S. Pat. No. 5,355,969 of Hardy et al., concentric circular or semicircular ridges and grooves about a central axis of the interface are shown.

In U.S. Pat. No. of 5,351,772 of Smith, a wide variety of interfacial patterns is shown with radially directed, interleaved grooves and ridges.

In U.S. Pat. No. 5,590,728 of Matthias et al., table-substrate interfaces are shown with generally radially directed grooves and ridges having straight, angular, bulbous, or somewhat twisted configurations.

In U.S. Pat. No. 5,611,649 of Matthias, a star-shaped pattern of interfacial grooves and ridges is shown. Both U.S. Pat. No. 5,611,649 of Matthias and U.S. Pat. No. 5,617,928 of Matthias et al. teach the use of concentric semicircular grooves and ridges with a central axis outside or nearly outside the circumferential periphery of the table and substrate.

Despite all the aforementioned suggested improvements in the interface design, cutting elements continue to fail because of high loads and attendant stresses experienced during drilling operations. Drill bit repair and replacement and consequent lost rig time comprise major expenses in the drilling industry. Thus, further advancements in the art are necessary to enhance the cutting table-substrate bond strength in order to improve drill bit performance reduce downtime and the necessity for cutting element replacement and drill bit replacement and repair.

BRIEF SUMMARY OF THE INVENTION

The cutting element of the present invention comprises a substantially planar table of circular, polygonal or other suitable cross-section comprising superabrasive material having an underside joined along a three-dimensional interface to a supporting substrate. At the interface, a pattern comprising one or more corresponding grooves and ridges is formed so that the table material projects into the substrate, and/or vice versa. The particular interfacial groove-and-ridge pattern of the present invention includes at least one narrow elongate groove which forms a pattern with a plurality of outwardly extending lobes. The pattern, which may also be characterized as a wave pattern, lies completely within the circumferential periphery of the cutting element, forming a series of generally radially inwardly and outwardly facing arches which alleviate and distribute temperature-induced stress in the interface region upon cooling of the cutting element of the fabrication, as well as enabling the cutting element to better withstand Normal and tangential impact loading-induced stresses experienced during drilling. Preferably, the number of lobes or arches of the interface pattern comprises a whole number from 2 to about 30 and, more preferably, a whole number from about 3 to about 24, although the preferred upper limit may vary with the size (diameter) of the cutting element.

A ridge of the pattern may comprise an extension or protrusion of the superabrasive table which fills a complementary groove in the substrate or, alternatively, may comprise an extension of the substrate material which fills a complementary groove in the cutting table.

The wave pattern as a whole may comprise a continuous, generally sinusoidal function located within a range of radii about the central axis of the cutting element. Two or more wave patterns may be used, each located within a different radius range, i.e., in a generally concentric configuration. The range of radii of adjacent wave patterns may overlap. The periods as well as the amplitudes of the wave patterns may differ. Thus, an inner wave pattern may have less, the same, or more outwardly directed lobes or arches than a relatively outer wave pattern.

Normally, the period and amplitude of a wave pattern may be uniform, i.e., non-variable. However, the period and amplitude within a given wave pattern may be configured to be non-uniform. Thus, a pattern with varied lobe sizes and/or spacings is formed.

The continuous wave pattern about a longitudinal, e.g., central axis of the cutting element may comprise a simple or complex sine function. Alternatively, the wave pattern may be a series of semicircles, hemi-ellipses, etc., having their ends joined and arranged in a continuous circumferential pattern about the central axis, wherein the convex faces of the arcuate lobes are directed outwardly.

The attachment surface, i.e., underside, of the table is formed on and bonded to the substrate by any method which provides the desired bond strength and hardness characteristics. Typically, the table is integrally formed and bonded to the substrate during sintering under conditions of high temperature and pressure as known in the art.

The cutting element is typically configured to be mounted to a drill bit for boring in subterranean formations.

The present invention is particularly applicable to PDC, TSP and cubic boron nitride compact cutting elements, but is not so limited.

In the present invention, the ability of an arcuate structure to absorb and distribute high applied loads is utilized to advantage. The multiple arches of the wave pattern, facing the direction from which normal drilling stresses occur, distribute such drilling loads to preclude fracture, spalling, and delamination of the superabrasive table. The arcuate wave pattern of ridges and grooves also enhances resistance to interfacial debonding of the table from the substrate during fabrication of the cutting element and during attachment thereof to a drill bit.

While it is currently contemplated that the groove and corresponding ridge structures be physically continuous in the sense of being unbroken or unsegmented, as used herein, the term "continuous wave pattern" denotes that the overall pattern itself is substantially continuous, but does not preclude the formation of such patterns using intermittent or segmented ridges and cooperative grooves, so that a given pattern may resemble, or be defined by, a dotted or broken line comprising groove and matching ridge segments, instead of a continuously extending physical structure. Moreover, the ridge and groove segments need not be of equal length throughout a given pattern.

BRIEF DESCRIPTION OF THE DRAWINGS

The following drawings illustrate various exemplary embodiments of the invention, not necessarily drawn to scale, wherein.

DETAILED DESCRIPTION OF THE PREFERRED EMBODIMENTS

In this invention, superabrasive cutting elements for earth boring drill bits are formed in a manner which reduces the incidence of fracture and separation of the cutting table from the underlying substrate along the table-substrate interface.

Figure 1:
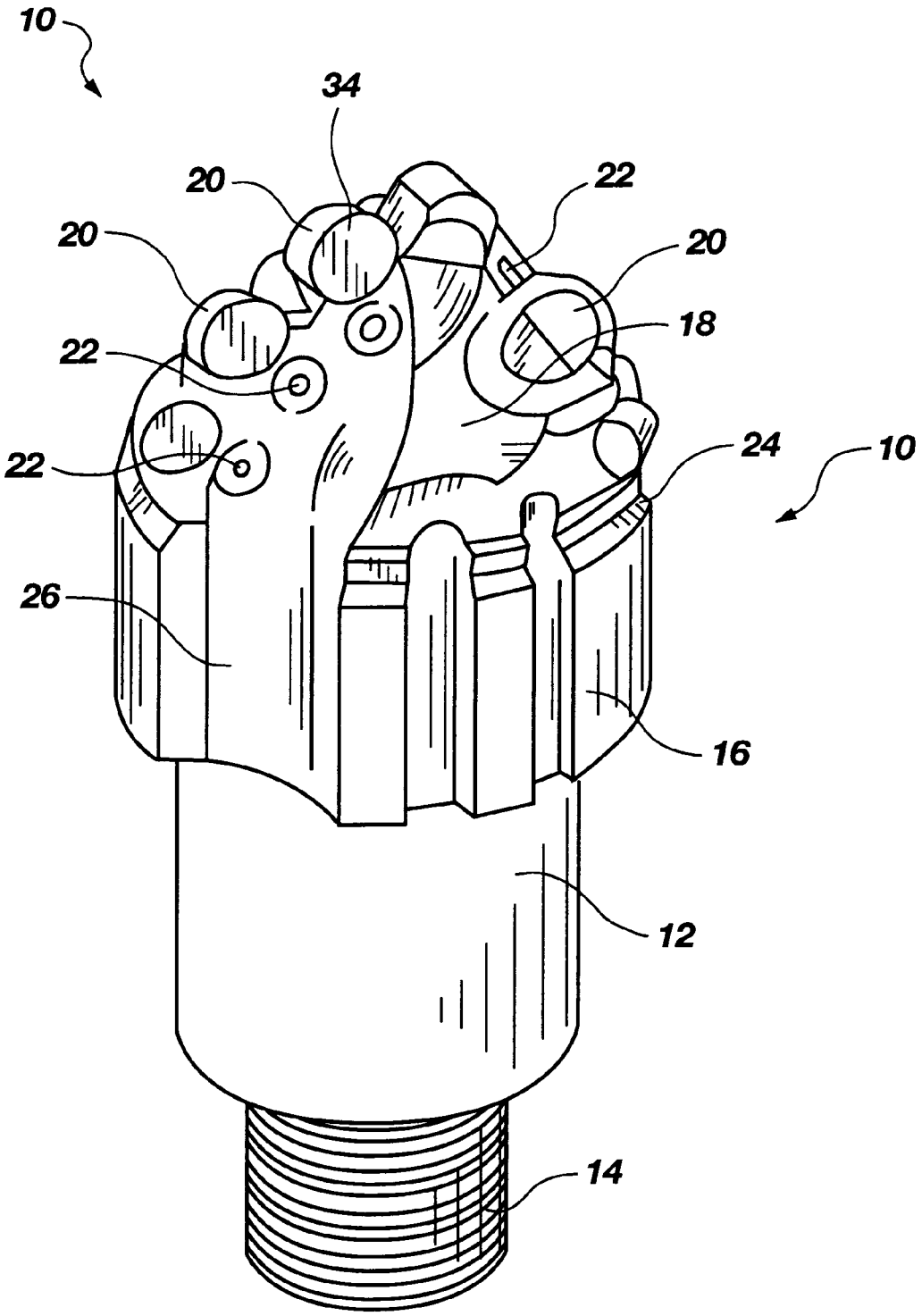
FIG. 1 is a perspective view of an exemplary drill bit incorporating cutting elements of the present invention.

In FIG. 1 is shown an exemplary, but not limiting, drill bit 10 which incorporates cutting elements 20 of the invention. Drill bit 10 is known in the art as a rotary, fixed cutter, or "drag" bit, useful for drilling in subterranean formations such as formations above oil and gas-bearing formations as well as the latter. Cutting elements 20 of this invention may be advantageously used in any of a wide variety of drill bit configurations which use superabrasive cutting elements. Drill bit 10 includes a bit shank 12 having a pin end 14 for threaded connection to a drill string, not shown, and also includes a body 16 having a face 18 on which cutting elements 20 may be secured. Bit 10 typically includes a series of nozzles 22 for directing drilling mud to the bit body face 18 for removal of formation cuttings to the bit gage 24 and passage thereof through junk slots 26, past the bit shank 12 and drill string to the ground surface. The improved cutting elements 20 of this invention have one or more generally concentric multiple arch or lobe patterns in the table-substrate interface 36 (see FIG. 2), which reduces the incidence of spalling, fracture and delamination of the table from the substrate, any of which may lead to catastrophic cutting element failure.

The cutting element 20 of the present invention includes a superabrasive table 30 of circular, rectangular or other polygon, oval, truncated circular, or other suitable crosssection, although circular is preferred. The cutting element 20 is formed with a cutting face 34 comprising one side of the table 30 of the superabrasive material such as polycrystalline diamond, the table 30 having an underside (attachment) face 32 joined to a supporting substrate 40 formed of a hard material such as a cemented tungsten or other carbide. The substrate may be preformed in a desired shape such that a crystalline diamond material may be molded into the polycrystalline diamond table 30 thereon and simultaneously strongly bonded to the substrate under sintering conditions. The table 30 which is formed is complementary to the substrate 40 such that a unitary, solid cutting element 20 is formed with essentially no voids at the table substrate interface 36.

The projection of the groove pattern 44 in the substrate 40 or table 30 is essentially identical to that of the ridge pattern 54 in the opposing member, the ridge 50 thus filling the groove 60. The combined ridge-and-groove pattern will be identified herein by the numeral 38 (also referred to herein as "wave pattern 38"). Such a pattern 38 includes a ridge 50 and a groove 60 which together delineate a wave pattern in the interface 36 between table 30 and substrate 40.

Figure 2:
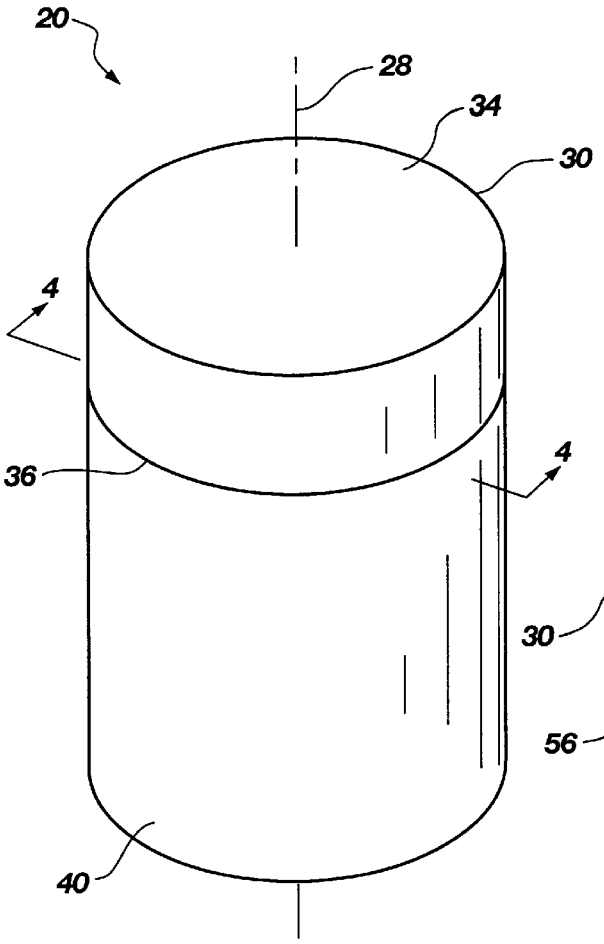
FIG. 2 is an enlarged perspective view of an exemplary cutting element of the invention.
Figure 3:
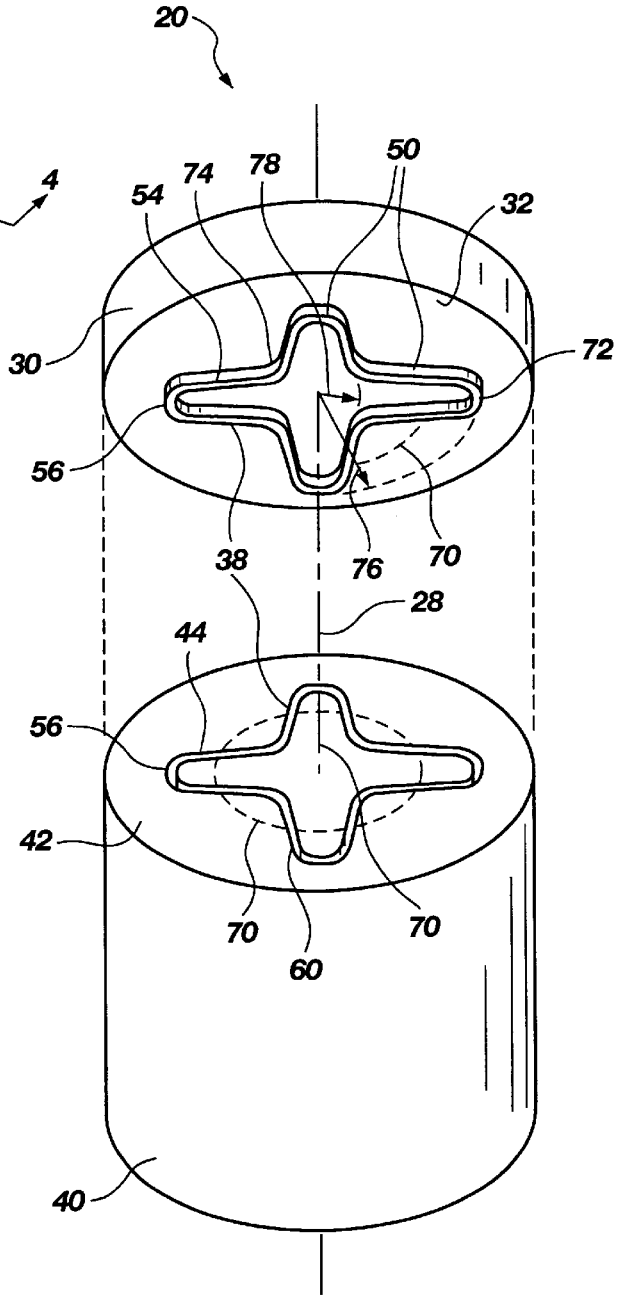
FIG. 3 is a perspective exploded view of an exemplary cutting element of the invention.
Figure 4:
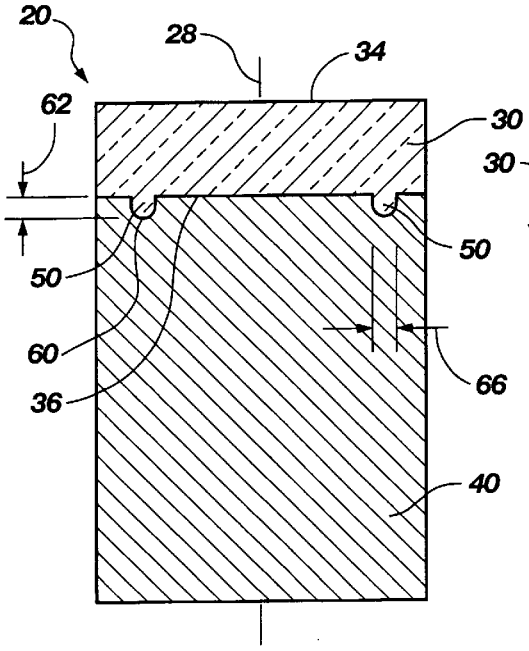
FIG. 4 is a reduced cross-sectional view of an exemplary cutting element of the invention, as taken along line 4—4 of FIG. 2.

As shown in FIGS. 2, 3 and 4, a cutting element 20 of the invention comprises a table 30 with a cutting face 34 and an attachment face 32, and a substrate 40 with a matching attachment face 42. The interface, including both attachment faces 32, 42, ridge pattern 54 and groove pattern 44, is identified herein by the numeral 36.

The cutting element 20 is depicted as having a central axis 28 and a generally circular cross-section about the axis. Alternatively, the cutting element 20 may have multiple sides or surfaces lying about axis 28. Thus, for example, the cutting clement 20 may have a hexagonal, rectangular, or oval cross-section.

In FIG. 3, a ridge 50 with ridge pattern 54 is shown as comprising a continuous, narrow, elongate extension or protrusion of the material of table 30 from the table attachment face 32. A groove 60 with matching groove pattern 44 is shown in the attachment face 42 of the substrate 40. When the table 30 is joined (typically formed on) to the substrate 40, the ridge 50 fills the groove 60.

In the example of FIGS. 3 and 4, the groove-and-ridge pattern 38 is shown as a continuous, generally angular, sinusoidal configuration of ridge 50 and groove 60 about radius 70. The amplitude is the maximum deviation from radius 70, and may be positive or negative. In the convention used herein, a positive amplitude 72 is indicated when the radius 76 from central axis 28 exceeds the radius 70. A negative amplitude 74 is indicated when the radius 78 from central axis 28 is less than radius 70.

In FIGS. 3 and 4, the groove-and-ridge pattern 38 has a period P of one fourth of a complete revolution about central axis 28. Thus, the number of outwardly extending lobes or arches 56 on attachment faces 32, 42 equals four.

Figure 4A:
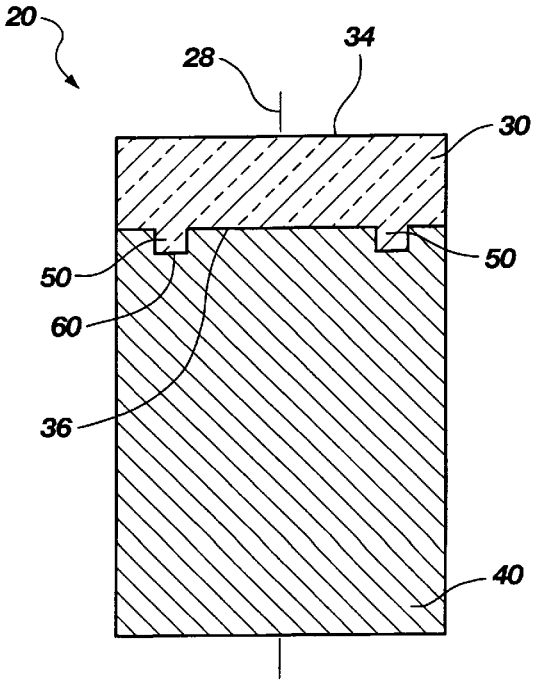
FIG. 4A is a reduced cross-sectional view of another exemplary cutting element of the invention, as taken along line 4—4 of FIG. 2.

The ridge 50 (and matching groove 60) is shown as having a generally radiused cross-sectional shape in FIG. 4. This is the preferred shape from the standpoint of resistance to fracture, but other shapes may be used, including quadrilateral as depicted in FIG. 4A. The groove depth dimension 62 may be typically about 0.2 to 1.5 times the groove width 66. In general, it is currently believed that the groove width 66 may preferably vary from about 0.2 to about 1.5 mm, and the groove depth 62 from about 0.04 to about 2.2 mm. The width and depth of the matching ridge 50 will, of course, be in the same range.

In this description, an outermost wave pattern 38 may be characterized for convenience as a "primary" wave pattern, inasmuch as additional wave patterns 38A may be concentrically formed within the primary wave pattern 38.

Figure 6:
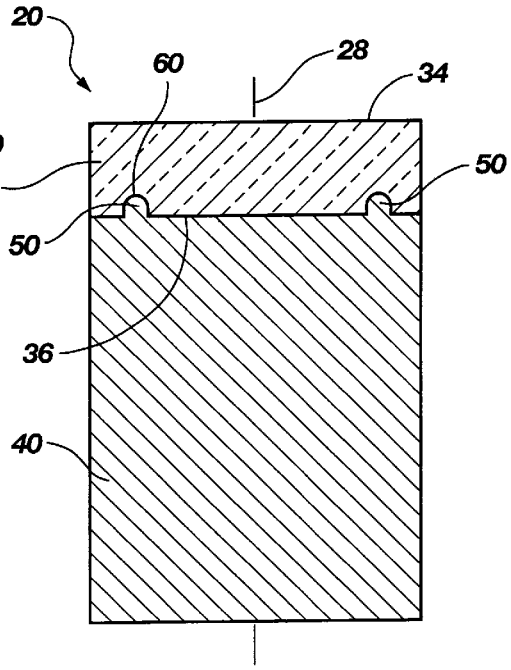
FIG. 6 is a reduced cross-sectional view of another exemplary embodiment of a cutting element of the invention, as taken along line 6—6 of FIG. 5.
Figure 5:
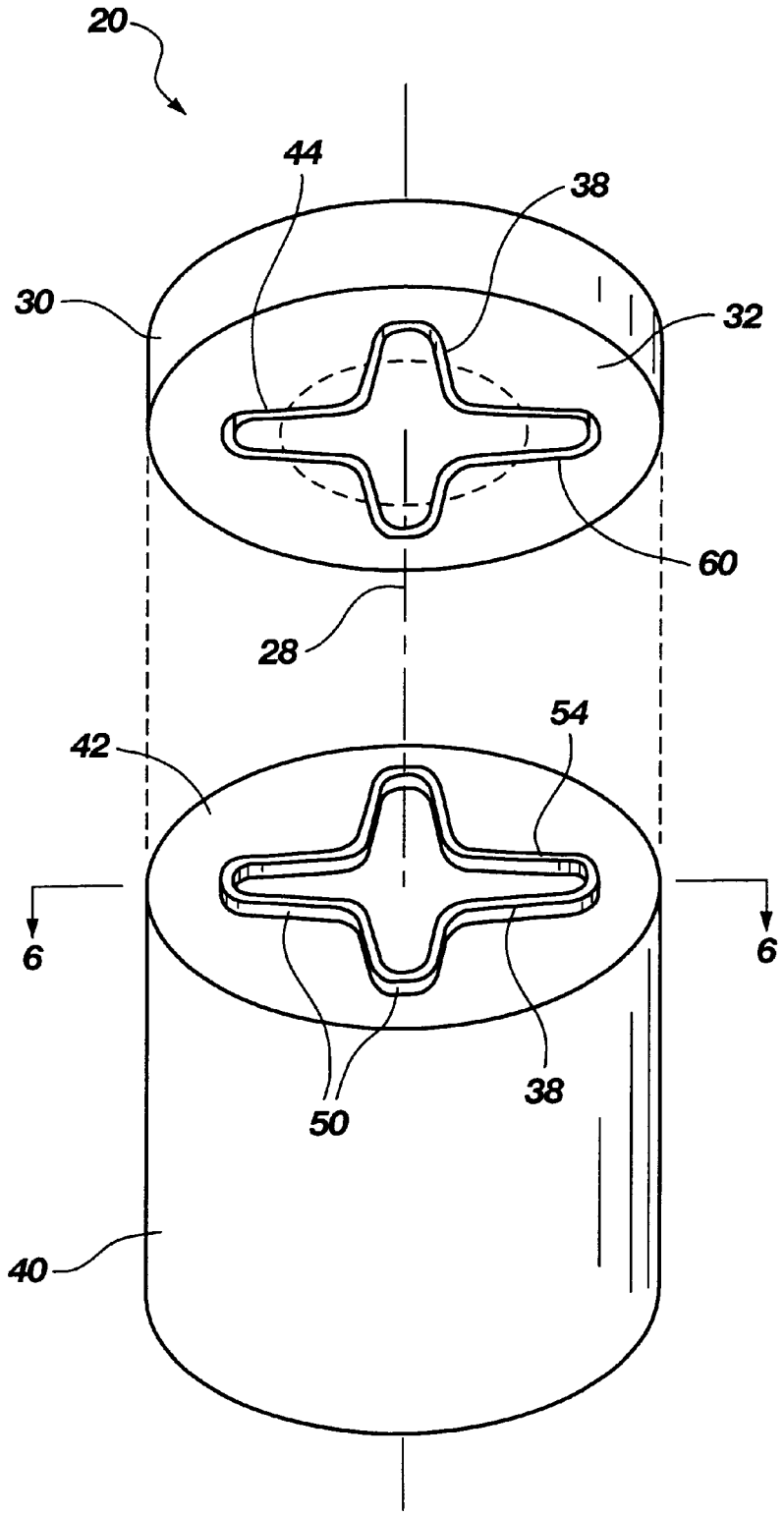
FIG. 5 is a perspective exploded view of another exemplary embodiment of a cutting element of the invention.

Turning to FIGS. 5 and 6, the table 30 and substrate 40 of a cutting element 20 are shown. As compared to the embodiment of FIG. 3, the groove pattern 44 and ridge pattern 54 are reversed, so that the ridge 50 projects from the substrate 40 into a groove 60 in the table 30 of superabrasive material. In each of the various patterns 38 which may be used, the ridge 50 may project from either the table 30 or substrate 40. As will be seen, infra, when multiple generally concentric patterns 38 are used, the ridge 50 of each pattern may project from either the table 30 or substrate 40.

The particular interfacial groove-and-ridge pattern 38 of this invention includes a narrow elongate groove 60 (and matching ridge 50) which forms a wave pattern 38 with a plurality of outwardly extending lobes or arches 56. The pattern 38 is completely within the circumferential periphery 46 of the interface 36, forming a series of lobes or arches 56 which alleviate and/or distribute both the temperature-induced stress upon cooling of the cutting element after fabrication and the normal and tangential impact stresses experienced during drilling. Preferably, the number of lobes or arches 56 comprises a whole number from 2 to about 30 and, more preferably, from 3 to about 24, although the preferred upper limit is somewhat dependent upon the diameter of the cutting element in question.

The wave pattern 38 may be a continuous, generally sinusoidal function about a base radius 70 of the central axis 28. Two or more wave patterns 38 may be used, each being a function of a different base radius 70, i.e., in a generally concentric configuration. The number of wave patterns 38 may be up to 6 or more. The periods P as well as the amplitudes 72, 74 of the wave patterns 38 may differ, although in a pure sinusoidal pattern, the amplitudes have the same absolute value. Normally, the period P and amplitudes 72, 74 of the wave pattern 38 may be uniform, i.e., non-variable. However, the period P and amplitudes 72, 74 within a given wave patterns 38 may be configured to be non-uniform. Thus, a pattern 38 with varied sizes and/or spacing of lobes or arches 56 may be formed.

The wave pattern 38 may comprise a sine function:

$$Y=Fb\sin(n\alpha+z)$$

where: Y=the radial distance from the base radius 70 of the function;

F=a function of any kind which changes the shape of the sinusoidal curve. For a simple pattern, F=1;

n=the number of outwardly extending lobes or arches 56 in a continuous groove-and-ridge pattern 38;

$\alpha$=the distance through which the wave function passes, as an angle about a centerpoint (e.g., center axis 28) of the base radius 70;

b is the amplitude of the sine function; and z is a function which moves the entire sinusoidal pattern about a centerpoint which normally is the center axis 28. Normally, z is set at zero.

The variable $\alpha$ is an angular function comparable to linear variable X of a linear sinusoidal function Y=sin X. The function Y may be positive or negative relative to the base radius 70. In this application, Y is considered positive when the radial distance 76 from the central axis 28 exceeds the base radius 70, and negative when the radial distance 78 from the central axis 28 is less than the base radius 70.

Figure 7:
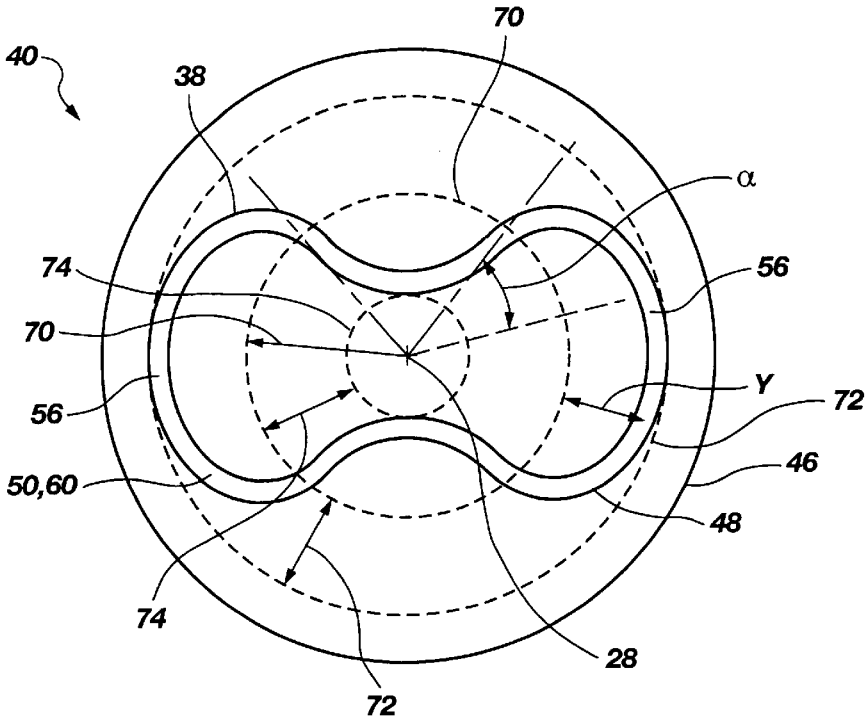
FIG. 7 is an enlarged plan view of a substrate-table interface having an exemplary two-lobe interfacial pattern of a cutting element of the invention.

FIGS. 7 through 12 are enlarged plan views of the interface 36 of various exemplary embodiments of the invention, not intended to be limitations thereof. The wave functions are depicted as being taken along the outer edge 48 of the ridge 50 or groove 60. In FIG. 7, a wave pattern 38 of ridge 50 and groove 60 is shown with two outwardly extending lobes or arches 56. The radial position Y is a function of the positive and negative amplitudes 72, 74, angle $\alpha$ and the value of radius 70. The period P of the function is 180 degrees and the frequency F is 360/P, i.e., 2.0.

Figure 8:
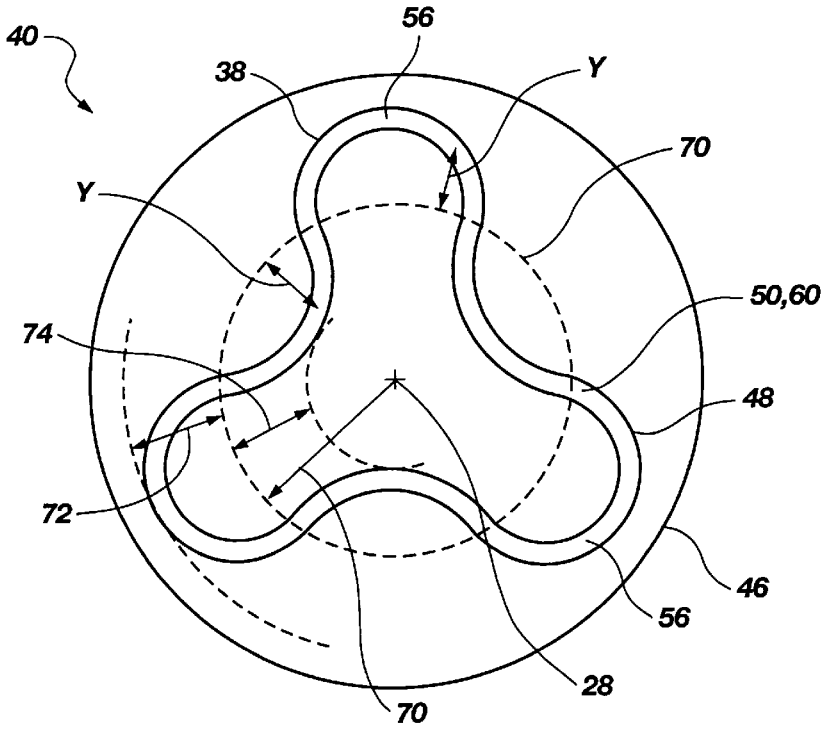
FIG. 8 is an enlarged plan view of a substrate-table interface having an exemplary three-lobe interfacial pattern of a cutting element of the invention.

In FIG. 8, a wave pattern 38 with three lobes 56 is shown. The positive and negative maximum amplitudes 72, 74 of radial position Y are depicted. The period P of the wave function is 120 degrees and the frequency F is 360/P, i.e., 3.0.

Figure 9:
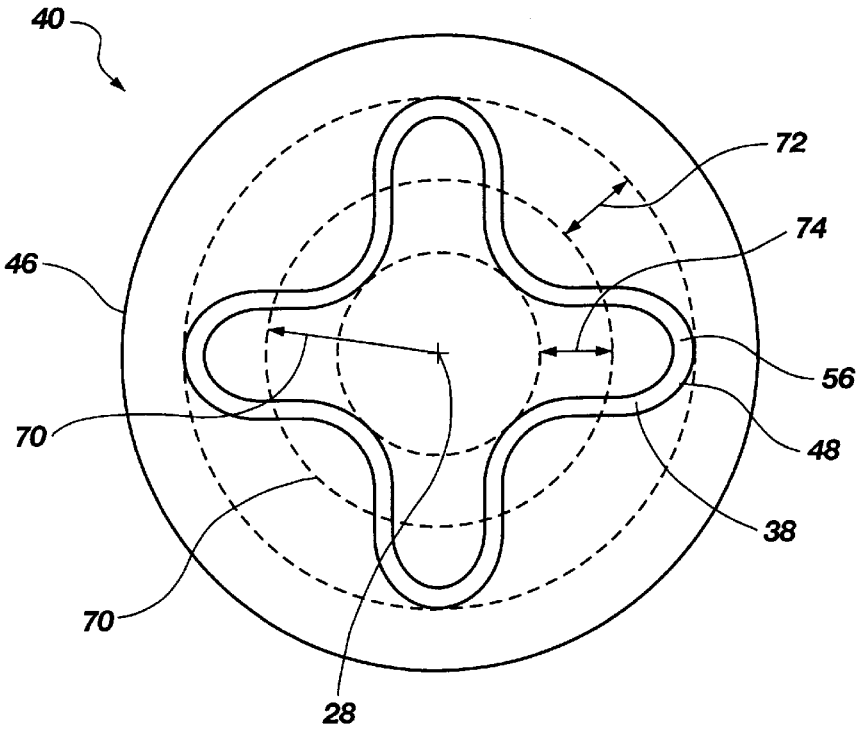
FIG. 9 is an enlarged plan view of a substrate-table interface of an exemplary four-lobe interfacial pattern having a cutting element of the invention.

In FIG. 9, a wave pattern 38 with four lobes 56 is shown with a period P of 90 degrees and a frequency of 4.0. The maximum positive and negative amplitudes 72, 74 are shown.

Figure 10A:
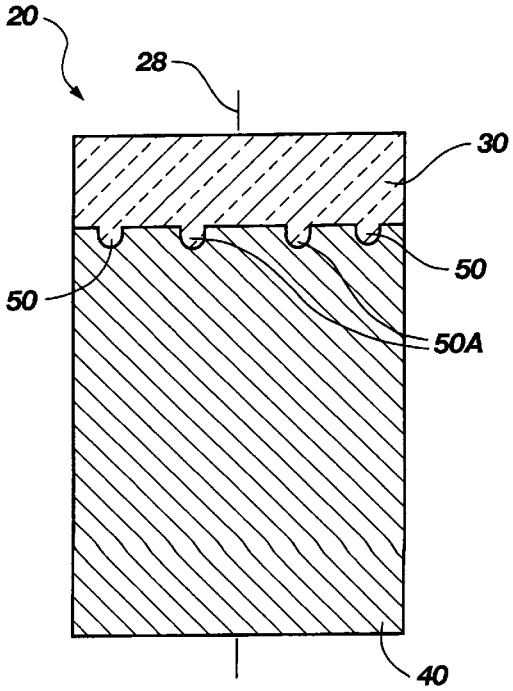
FIG. 10A is a reduced cross-sectional view of an exemplary four-lobe substrate-table interface of a cutting element of the invention, as taken along line 10A—10A of FIG. 10.
Figure 10:
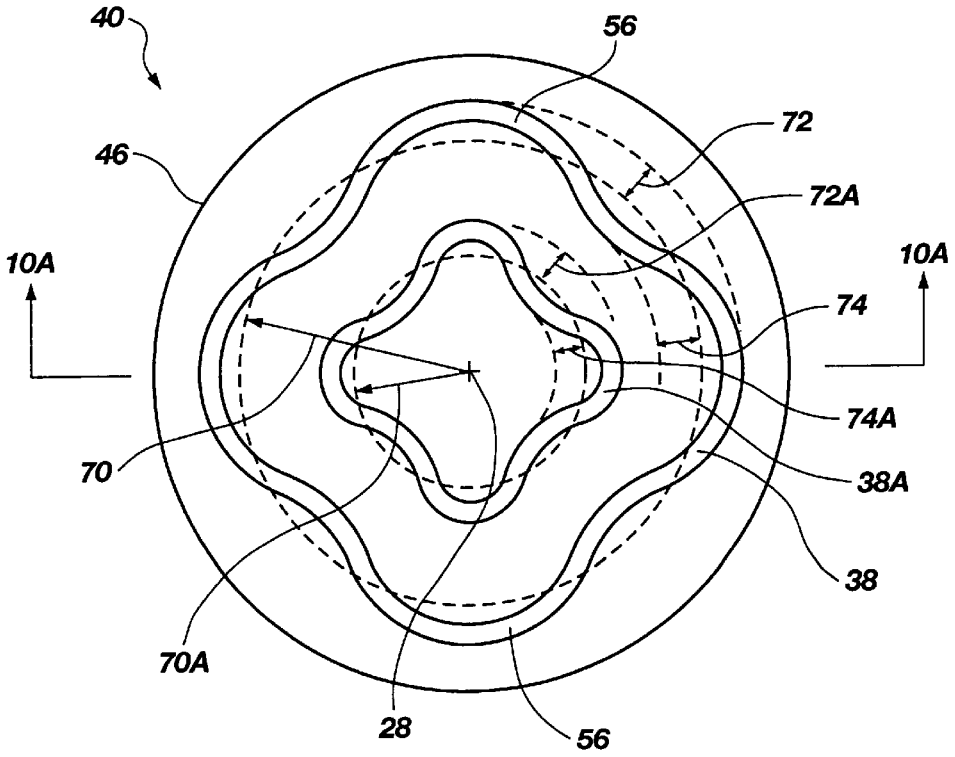
FIG. 10 is an enlarged plan view of a substrate-table interface having an exemplary four-lobe interfacial pattern of a cutting element of the invention.
Figure 10B:
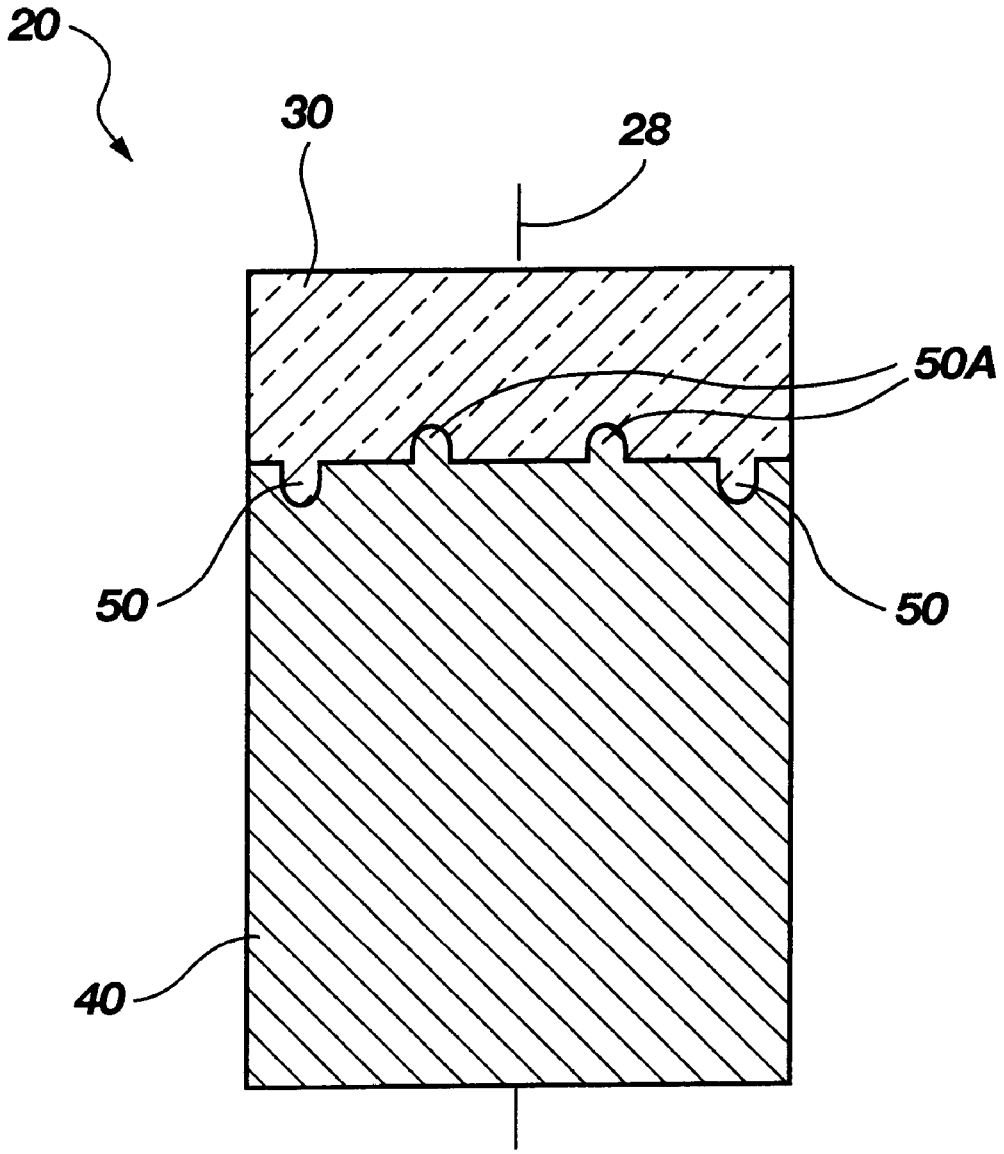
FIG. 10B is a reduced cross-sectional view of another exemplary four-lobe substrate-table interface of a cutting element of the invention, as taken along line 10A—10A of FIG. 10.

FIG. 10 depicts another exemplary cutting element interface 36 with a four-lobed wave pattern 38. In this embodiment, the amplitudes 72, 74 of wave pattern 38 are much reduced, i.e., about one-half the amplitudes of FIG. 9. In addition, a second wave pattern 38A, smaller than wave pattern 38, is positioned generally concentric to wave pattern 38. The second wave pattern 38A has a base radius 70A which is smaller than radius 70, and has amplitudes 72A and 74A which in this case are slightly smaller than amplitudes 72 and 74. In FIG. 10A, the ridges 50 and 50A both extend from the table 30 into grooves 60 in the substrate 40. As shown in FIG. 10B, one or both of the ridge patterns 50, 50A may alternatively extend from the substrate 40 into the table 30. This is true regardless of how many wave patterns 38 are formed in the interface 36.

Figure 11:
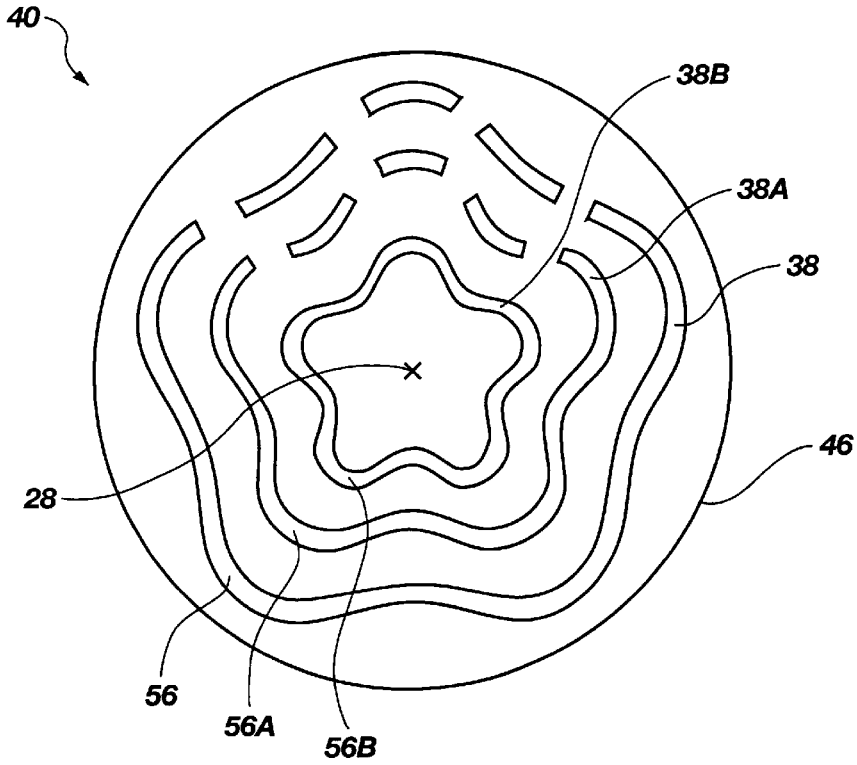
FIG. 11 is an enlarged plan view of a substrate-table interface with an exemplary, triple five-lobe interfacial pattern of a cutting element of the invention.

FIG. 11 illustrates an exemplary substrate 40 with three interfacial ridge/groove patterns 38, 38A and 38B arranged concentrically. Each pattern 38, 38A and 38B has five outwardly extending lobes 56, 56A and 56B of differing amplitude. Theoretically, a large number of patterns may be formed on an interface 36, depending upon ridge width. From a practical standpoint, however, the useful number of patterns on a given interface may be one to about twelve, depending on the size of the cutting element 20. Generally, the amplitudes 72, 74 must be reduced to permit higher numbers of concentric wave patterns 38. As alluded to previously, and as shown in the upper portion of FIG. 11, the interfacial ridge/groove patterns may be segmented or intermittent in physical structure, although substantially continuous in terms of the patterns themselves. It is contemplated that a given pattern will be either structurally continuous or structurally segmented as a whole (i.e., about its entire length), although such is not required.

Figure 12:
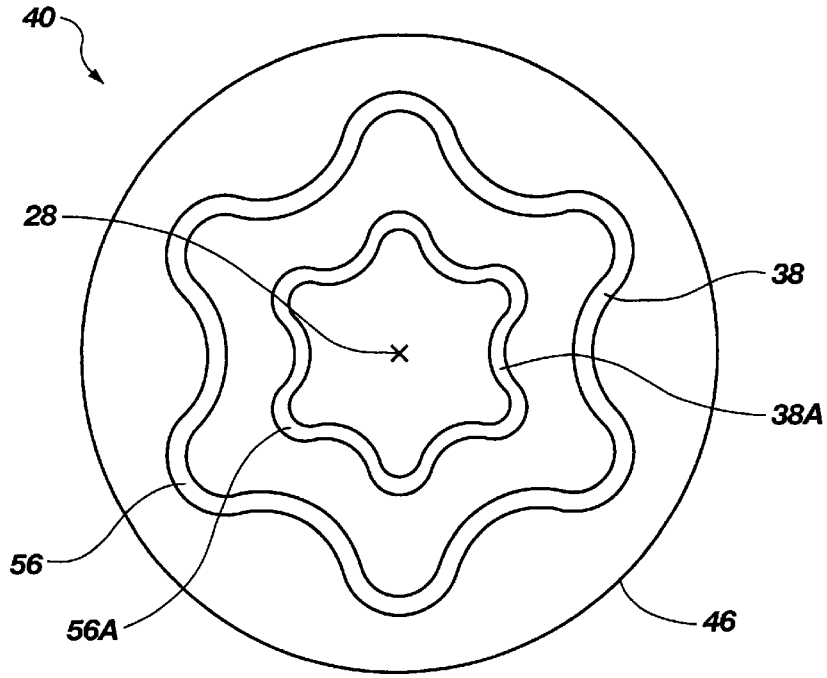
FIG. 12 is an enlarged plan view of a substrate-table interface with an exemplary, double six-lobe interfacial pattern of a cutting element of the invention.

In FIG. 12, an exemplary substrate 40 is shown with two wave patterns 38 and 38A in generally concentric relationship. Each wave pattern 38, 38A has six lobes or arches 56, 56A, respectively.

Figure 13:
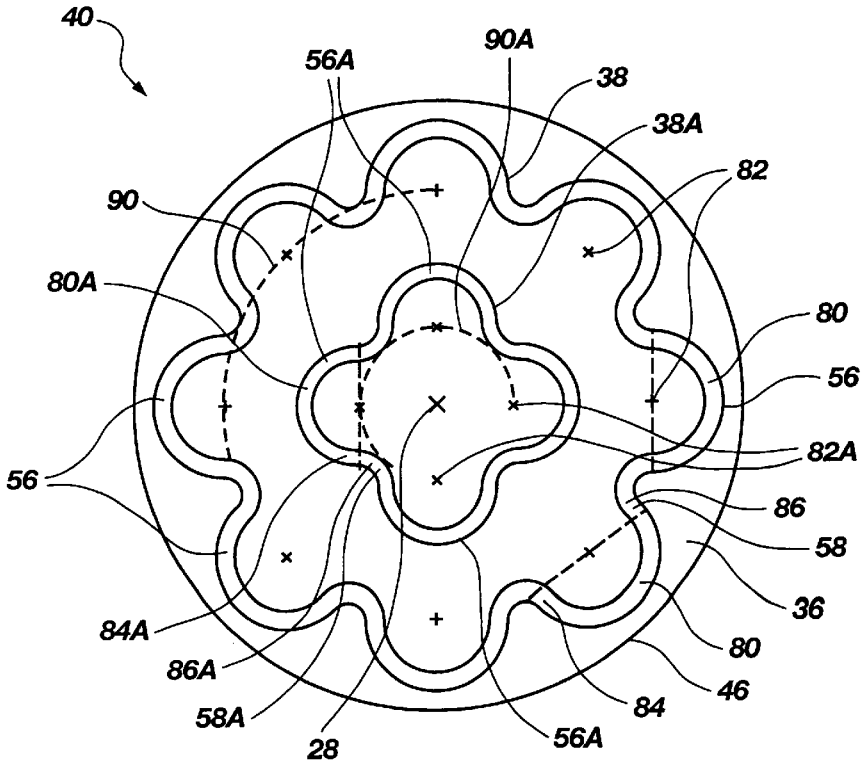
FIG. 13 is an enlarged plan view of a substrate-table interface with an exemplary, outer eight-lobe interfacial pattern combined with an inner four-lobe pattern of a cutting element of the invention.

In another embodiment of the invention shown in FIG. 13, each of two wave patterns 38 and 38A comprises a series of semicircles 80, 80A having their loci 82, 82A arranged in regular order in a circle 90, 90A about axis 28. Each semicircle 80, 80A is an outwardly extending lobe or arch 56, 56A. The semicircles 80, 80A have their ends 84, 84A smoothly joined by connecting portions 86, 86A, shown here as arcuate members which themselves form small inwardly directed lobes or arches 58, 58A. The convex face 88, 88A of each semicircle 80, 80A is outwardly directed to face and distribute high loads which impinge on the table 30 and along interface 36 during drilling.

Figure 14:
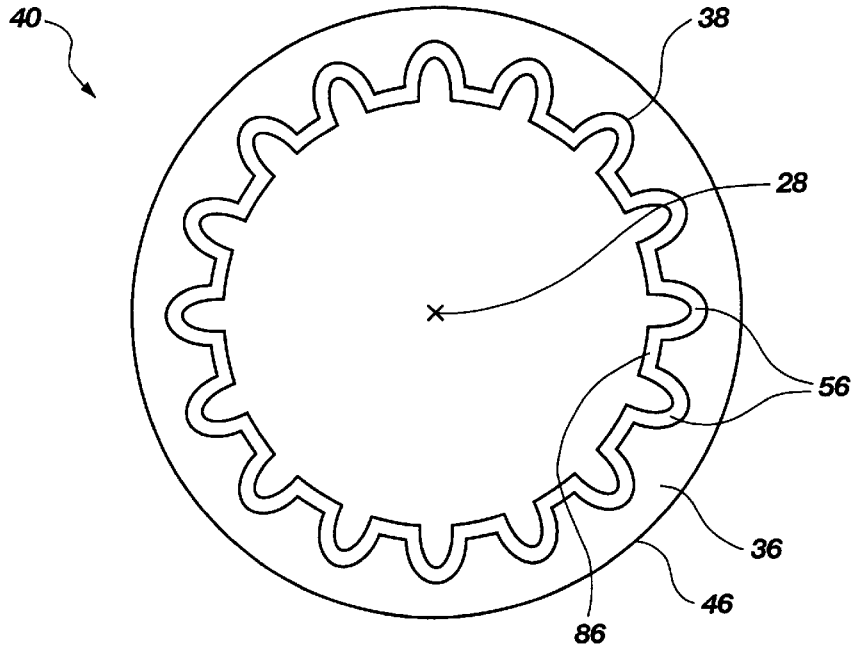
FIG. 14 is an enlarged plan view of a substrate-table interface with an exemplary sixteen-lobe interfacial pattern of a cutting element of the invention.

In a further embodiment depicted in FIG. 14, a wave pattern 38 comprises a series of outwardly directed hemielliptical lobes or arches 56. The number of lobes may vary from 2 to about 30. Preferably, the number of lobes varies from 3 to about 24, and in a more preferred embodiment, the number may be from 4 to about 20. The lobes 56 are joined by connecting portions 86 which may be straight or arcuate. In this example, the connecting portions 86 are radial about central axis 28.

As shown in each of the figures, the entire wave pattern(s) 38 is (are) within the periphery 46 of the interface 36, so that a plurality of outwardly extending arches or lobes 56 and intermediate inwardly extending arches or lobes 58 together form a continuous curve at the interface 36. Preferably, the curve is sinuous, i.e., has no sharp corners. The series of outwardly extending arches 56 is primarily responsible for the increased resistance to fracture, and the inwardly extending arches 58 provide additional strength and integrity to the interface 36.

The cutting element 20 of the present invention, having an interfacial wave pattern 38 of outwardly extending lobes or arches 56, has superior resistance to fracture and spalling of the table 30, delamination thereof from substrate 40 and overall failure of the cutting element 20 itself. In addition, the presence of the interfacial pattern 38 completely around the periphery 46 of the interface 36 of the cutting element 20 enables the cutting element to be removed, rotated about its central axis 28 and remounted in position on the drill bit to expose fresh superabrasive material to engage the formation when an initial cutting edge of the cutting element becomes worn.

The foregoing description mentions, by way of example only, some of the variables which fall within the purview of the invention, including the number of wave patterns, numbers, sizes, spacing and shapes of lobes, and the like, and is not limiting to the scope of the invention.

This invention may be embodied in many forms without departing from the spirit of essential characteristics of the invention. The embodiments as described herein are therefore intended to be only illustrative and not restrictive, and the scope of the invention is defined by the appended claims rather than the preceding description, and all variations that fall within the metes and bounds of the subject matter claimed, or are equivalent thereto, are therefore intended to be embraced by the claims which follow:

What is claimed is:

1. A cutting element for use on a rotary drill bit for drilling subterranean formations, said cutting clement comprising:

a substrate having an attachment face exhibiting a pattern including at least one of a projecting ridge of material and a groove; and a superabrasive table having an attachment face complementary to said substrate attachment face with at least another of said projecting ridge of material and said groove and joined to said substrate attachment face to define a three-dimensional interface between said substrate and said superabrasive table;

wherein said pattern comprises at least one elongate element outlining a plurality of outwardly extending arcuate lobes.

2. The cutting element of claim 1, wherein said substrate attachment face and said table attachment face are substantially planar.

3. The cutting element of claim 1, wherein said substrate attachment face and said table attachment face have coextensive arcuate peripheral limits.

4. The cutting element of claim 1, wherein said substrate attachment face and said table attachment face predominantly comprise flat surfaces.

5. The cutting element of claim 1, wherein said substrate attachment face and said table attachment face are substantially circular.

6. The cutting element of claim 1, wherein said at least one projecting ridge and said at least one groove of said pattern comprise mirror images of a substantially continuous, multi-lobed wave pattern having opposing amplitudes about a circle with a base radius.

7. The cutting element of claim 6, wherein said multi-lobed wave pattern approximates a sine function about said circle with said base radius about a centerpoint.

8. The cutting element of claim 7, wherein said cutting element is generally cylindrical in shape with a generally central longitudinal axis, and said base radius circle has an approximate constant radius from said generally central longitudinal axis.

9. The cutting element of claim 7, wherein said sine function comprises:

$$Y=Fb\sin(n\alpha+z)$$

where:

Y is the radial distance from said base radius circle;

F is a function of any kind which changes the shape of said ridge pattern and groove pattern;

b is the amplitude of the sine function;

n is the number of outwardly extending lobes;

$\alpha$ is the angle taken about said centerpoint; and z is a constant which moves an entire sinusoidal curve about the centerpoint.

10. The cutting element of claim 1, wherein said plurality of outwardly extending lobes comprises a number of lobes from two to thirty.

11. The cutting element of claim 1, wherein said plurality of outwardly extending lobes comprises a number of lobes from three to twenty-four.

12. The cutting element of claim 1, further comprising at least one additional pattern concentric to and at least partially radially within said pattern of outwardly extending arcuate lobes.

13. The cutting element of claim 12, wherein said at least one additional pattern comprises two to six additional patterns.

14. The cutting element of claim 1, wherein said pattern comprises at least one ridge projecting from said table into at least one groove in said substrate.

15. The cutting element of claim 1, wherein said pattern comprises at least one ridge projecting from said substrate into at least one groove in said table.

16. The cutting element of claim 15, wherein said pattern further comprises at least one ridge projecting from said table into at least one groove in said substrate.

17. The cutting element of claim 1, wherein said superabrasive table comprises polycrystalline diamond.

18. The cutting element of claim 1, wherein said substrate comprises a carbide material.

19. A rotary drill bit, comprising:

a bit body having a face; and at least one cutting element mounted over said bit face, said at least one cutting element including a substrate supporting a table of superabrasive material along a three-dimensional interface defined by an attachment surface of said table and a complementary attachment surface of said substrate;

said substrate attachment surface exhibiting a pattern including at least one of a projecting ridge of material and a groove;

said table attachment face having at least another of said projecting ridge of material and said groove;

wherein said pattern comprises at least one elongate element outlining a plurality of outwardly extending arcuate lobes.

20. The rotary drill bit of claim 19, wherein said substrate attachment face and said table attachment face are substantially planar.

21. The rotary drill bit of claim 19, wherein said substrate attachment face and said table attachment face have coextensive arcuate peripheral limits.

22. The rotary drill bit of claim 19, wherein said substrate attachment face and said table attachment face predominantly comprise flat surfaces.

23. The rotary drill bit of claim 19, wherein said substrate attachment face and said table attachment face are substantially circular.

24. The rotary drill bit of claim 19, wherein said at least one projecting ridge and said at least one groove of said pattern comprise mirror images of a substantially continuous, multi-lobed wave pattern having opposing amplitudes about a circle with a base radius.

25. The rotary drill bit of claim 24, wherein said multi-lobed wave pattern approximates a sine function about a circle with a base radius about a centerpoint.

26. The rotary drill bit of claim 25, wherein said at least one cutting element is generally cylindrical in shape with a generally central longitudinal axis, and said base radius circle has an approximate constant radius from said generally central longitudinal axis.

27. The rotary drill bit of claim 25, wherein said sine function comprises:

$$Y=Fb\ \sin(n\alpha+z)$$

where:

Y is the radial distance from said base radius circle;

F is a function of any kind which changes the shape of said ridge pattern and groove pattern;

b is the amplitude of the sine function;

n is the number of outwardly extending lobes;

$\alpha$ is the angle taken about said centerpoint; and z is a constant which moves an entire sinusoidal curve about the centerpoint.

28. The rotary drill bit of claim 19, wherein said plurality of outwardly extending lobes comprises a number of lobes from two to thirty.

29. The rotary drill bit of claim 19, wherein said plurality of outwardly extending lobes comprises a number of lobes from three to twenty-four.

30. The rotary drill bit of claim 19, further comprising at least one additional pattern concentric to and at least partially radially within said pattern of outwardly extending arcuate lobes.

31. The rotary drill bit of claim 30, wherein said at least one additional pattern comprises two to six additional patterns.

32. The rotary drill bit of claim 19, wherein said pattern comprises at least one ridge projecting from said table into at least one groove in said substrate.

33. The rotary drill bit of claim 19, wherein said pattern comprises at least one ridge projecting from said substrate into at least one groove in said table.

34. The rotary drill bit of claim 33, wherein said pattern further comprises at least one ridge projecting from said table into at least one groove in said substrate.

35. The rotary drill bit of claim 19, wherein said superabrasive material comprises polycrystalline diamond.

36. The rotary drill bit of claim 19, wherein said substrate comprises a carbide material.

* * * * *

UNITED STATES PATENT AND TRADEMARK OFFICE

CERTIFICATE OF CORRECTION

PATENT NO. : 6,227,319 B1
DATED : May 8, 2001
INVENTOR(S) : Steven R. Radford

It is certified that error appears in the above-identified patent and that said Letters Patent is hereby corrected as shown below:

Column 1,
Line 28, delete the comma after “press”

Column 2,
Line 40, after “No.” delete “of”
Line 61, after “performance” and before “reduce” insert -- and to --

Column 4,
Line 46, after “interface” change “of” to -- having --
Lines 46-47, after “pattern” change “having” to -- of --

Column 5,
Line 50, change “table substrate” to -- table-substrate --

Column 9,
Line 17, change “clement” to -- element --
Lines 42-43, before “projecting” delete “at least one”
Line 43, before “groove” delete “at least one”
Line 61, before “radial” change “the” to -- a --
Line 62, before “shape” change “the” to -- a --
Line 63, after “said” and before “ridge” insert -- projecting --
Line 63, after “ridge” delete “pattern” and after “groove” insert -- of said --
Line 64, before “amplitude” change “the” to -- an --
Line 65, before “number” change “the” to -- a --
Line 66, before “angle” change “the” to -- an --

Column 10,
Lines 4 and 7, after “extending” and before “lobes” insert -- arcuate --
Line 17, after “ridge” insert -- of material -- and after “said” insert -- superabrasive --
Line 20, after “comprises” insert -- said --
Lines 20 and 23, after “ridge” insert -- of material --
Lines 21 and 24, before “table” insert -- superabrasive --
Line 31, after “bit” and before “face” insert -- body --
Line 35, after “table” insert -- of superabrasive material --
Line 40, after “attachment” change “face” to -- surface --
Lines 46, 49, 52 and 55, after “attachment” (both occurrences) change “face” to -- surface --
Lines 57-58, delete “at least one”
Line 58, after “ridge” insert -- of material -- and before “groove” delete “at least one”

UNITED STATES PATENT AND TRADEMARK OFFICE

CERTIFICATE OF CORRECTION

PATENT NO. : 6,227,319 B1
DATED : May 8, 2001
INVENTOR(S) : Steven R. Radford

It is certified that error appears in the above-identified patent and that said Letters Patent is hereby corrected as shown below:

Column 11,
Line 9, before “radial” change “the” to -- a --
Line 10, before “shape” change “the” to -- a --
Line 11, after “ridge” delete “pattern” and after “groove” insert -- of said --
Line 12, before “amplitude” change “the” to -- an --
Line 13, before “number” change “the” to -- a --
Line 14, before “angle” change “the” to -- an --
Lines 18 and 21, after “extending” and before “lobes” insert -- arcuate --

Column 12,
Lines 9 and 15, after “ridge” insert -- of material -- and after “table” insert -- of superabrasive material --
Line 12, after “ridge” insert -- of material --
Lines 13 and 16, after “table” insert -- of superabrasive material --

Signed and Sealed this

Twenty-third Day of November, 2004

JON W. DUDAS
*Director of the United States Patent and Trademark Office*